United States Patent [19]

Herrera

[11] 3,971,078

[45] July 27, 1976

[54] DEVICE FOR CHANGING THE POSITION OF THE HEAD SECTION OF HIDE-AWAY BED FRAMES

[76] Inventor: Jose Pardo Herrera, Carretera de Logrono, Km. 1, 7 Zaragoza, Spain

[22] Filed: Apr. 23, 1975

[21] Appl. No.: 570,835

[30] Foreign Application Priority Data

Apr. 30, 1974 Spain ..... 202693[U]

[52] U.S. Cl. ..... 5/66; 5/133; 5/327 R

[51] Int. Cl.[2] ..... A61G 7/06

[58] Field of Search ..... 248/410; 297/355, 377; 5/327 R, 327 B, 66, 67, 72, 149, 133, 71

[56] References Cited

UNITED STATES PATENTS

| | | | |
|---|---|---|---|
| 1,502,001 | 7/1924 | Koenigkramer | 297/377 X |
| 1,571,509 | 2/1926 | Connolly | 297/377 X |
| 1,903,224 | 3/1933 | Oehrl | 297/377 X |
| 3,539,142 | 11/1970 | Morand | 248/410 X |

*Primary Examiner*—Paul R. Gilliam
*Assistant Examiner*—Andrew M. Calvert
*Attorney, Agent, or Firm*—Ostrolenk, Faber, Gerb & Soffen

[57] ABSTRACT

For adjusting the tilt height of one end of a bed, a bed frame, a tiltable frame section attached to the frame, a longitudinally oriented bar secured to the section, a bar receiving means having an opening through which the bar passes supported on the frame, the receiving means opening being orientable from a position at which it misaligns with the bar and blocks sliding of the bar therethrough to a position at which it aligns with the bar and permits the bar to slide through, thereby permitting the frame section to gradually recover from tilted orientation.

5 Claims, 5 Drawing Figures

DEVICE FOR CHANGING THE POSITION OF THE HEAD SECTION OF HIDE-AWAY BED FRAMES

The invention relates to a device designed to facilitate changing the position of the head section of a bedframe particularly a frame which is suitable for use in a bed that is hidden from sight when the bed is not being used.

The improvement consists in the use of a jaw type clamp system which acts by the jaw cocking with respect to the sliding rod to squeeze the rod against further shifting, and with the intervention of spring action to retain the clamping jaw cocked, plus a cocking release means, e.g. a handle, attached to the jaw. These enable setting of a comfortable elevation of the head section of the frame with a simple muscular action on that section and enable a smooth descent without intermediate or sharp stops. This permits the placing of the head section at different reclining levels by means of a manual control which can be operated with very little effort by a person in the bed.

A preferred embodiment given by way of example, is shown in the accompanying drawings, in which.

Figure 1:
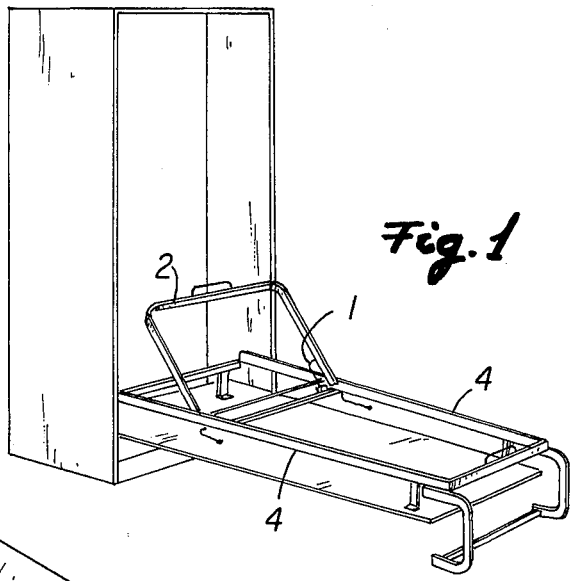
FIG. 1 is a perspective view of a frame containing the claimed device with the head section raised, ready for the bed to be used.

Turning to the drawings, the device of the invention is manually operated and is comprised of a longitudinal bar 1 that is curved at its joint end and is joined to the movable head semi-frame 2, which, in turn, is articulated at its axle 3 to the main bedframe 4.

Beneath frame 4 a flap 5 is soldered on one side or both sides of the frame (as the claimed mechanism can be single, or double in cases where it is installed on both sides of the frame) and its corresponding axle is articulated by means of a flat bar fork shaped holder 6 perforated in the center with web by a hole through which the longitudinal bar 1 passes.

Also, the fork 6 has a hole 7 in one of its sides at which one of the ends of a helicoidal spring 8 with controlled tension, is attached. The other end of the spring is attached to the bedframe 4.

The device is manually operated with a lever 9 which pivots on flap 5 and which also is an integral part of fork 6.

Figure 2:
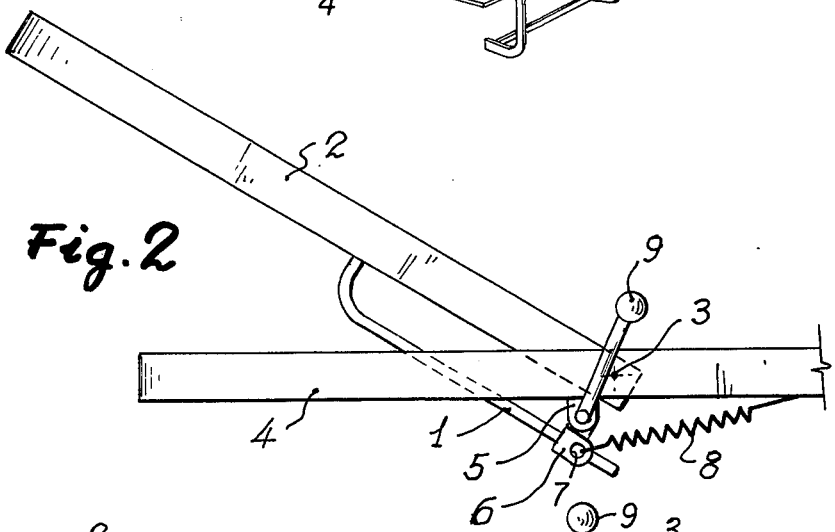
FIG. 2 is a side elevational view of the mechanism of the device with the head section of the frame in the raised position.
Figure 3:
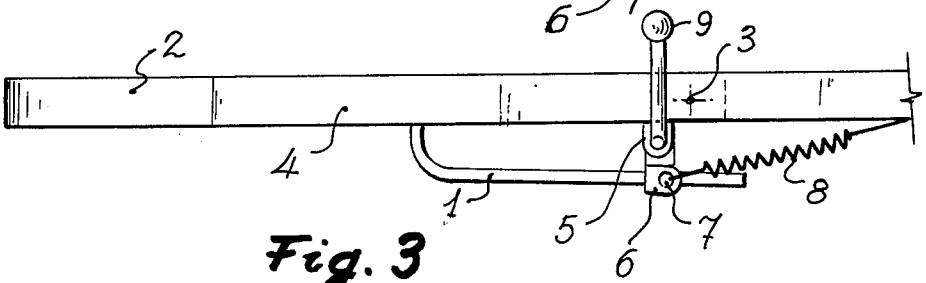
FIG. 3 is the same type of view as FIG. 2 with the head section of the frame in the lowered position.
Figure 4:
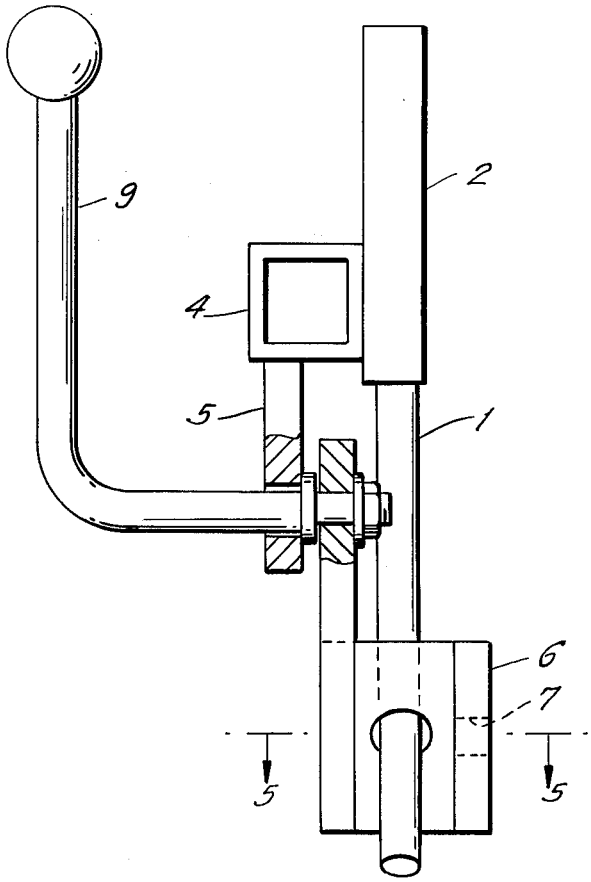
FIG. 4 is an end elevation view of the operating mechanism shown in FIG. 2.
Figure 5:
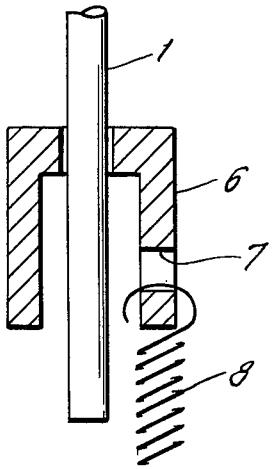
FIG. 5 is a cross-sectional view along the line of and in the direction of arrows 5—5 of FIG. 4 further showing the operating mechanism of FIG. 2.

To raise the head section 2 bar 1 is slid outwards (or to the left in FIGS. 2 and 3) from the forks 6 without any effort. The head section 2 is maintained at a chosen reclining angle by the simple cocking of the hole in the fork 6 or tilting of the fork with respect to the bar 1 as a consequence of the permanently exercised tension on the spring 8, which biases fork 6 to its cocked condition.

To lower the head section 2 lever 9 is operated or pivoted in such a way that the hole in said fork 6 is lined up with bar 1 which will enable a smooth descent by gravity action assisted by the weight of the bedclothes and of the user. The descent can be interrupted at any intermediate position by releasing or stopping the operation of said lever 9. In this way, the descent is smooth and continuous, totally eliminating momentary or repeated stops which result in sharp jerking, such as those produced by the toothed systems known at the present time. In addition, the device totally does away with bothersome noises.

All of the coincidental details such as shape, size and materials used in its construction, can be altered without such modifications detracting from the essence of that which is summarized in the following claims.

I claim:

1. A position changing device for changing the position of a head section of a bed frame, wherein the bed frame comprises:

a bed frame; a first pivot axis on said bed frame; a head section pivotally attached to said bed frame at said first pivot axis; said first pivot axis being so oriented as to enable said head section to pivot toward and away from an orientation generally aligned with the orientation of said bed frame;

said position changing device comprising:

a slide bar rigidly attached to said head section; said slide bar extending in a direction that is generally along the length of said head section; said slide bar being spaced a distance from said head section; said slide bar extending past said pivot axis and extending along a path that is spaced a distance from said first pivot axis, whereby as said head section pivots about said first pivot axis, said slide bar both pivots around said first pivot axis along with said head section and moves longitudinally along the length of said slide bar itself with respect to said pivot axis;

a slide bar lock support attached to said bed frame; a slide bar lock that is supported on its said support; said slide bar lock including one side having a hole therethrough, through which said slide bar passes; said hole being defined by side walls in said slide bar lock one side and said hole being sized and shaped such that when said one side is at a first tilt orientation with respect to said slide bar, said slide bar can freely slide through said hole, but when said one side is at a second tilt orientation with respect to said slide bar, said hole side walls engage said slide bar and prevent movement thereof, thereby to halt movement of said head section;

first slide bar lock tilting means connected to said slide bar lock for tilting it to said first tilt orientation; second slide bar lock tilting means connected to said slide bar lock for tilting it to said second tilt orientation.

2. The position changing device of claim 1, wherein said second slide bar lock tilting means comprises a spring means connected to said slide bar lock for normally biasing it to said second tilt orientation.

3. The position changing device of claim 2, wherein said slide bar lock is pivotally attached at a second pivot to said slide bar lock support and said slide bar lock one side pivots between its said first and its said second tilt orientations about said second pivot; said second pivot being spaced from said first pivot axis.

4. The position changing device of claim 3, wherein said spring means is connected between said slide bar lock and said bed frame.

5. The position changing device of claim 2, wherein said means operable for tilting comprises a graspable handle rigidly attached to said slide bar lock.

* * * * *